US006138437A

United States Patent [19]

Focke et al.

[11] Patent Number: 6,138,437

[45] **Date of Patent: *Oct. 31, 2000**

[54] APPARATUS FOR MANUFACTURING CIGARETTE PACKS

[75] Inventors: Heinz Focke, Verden; Thomas Häfker, Langwedel; Jürgen Schwecke, Hilgermissen, all of Germany

[73] Assignee: Focke & Co. (GmbH & Co.), Verden, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/129,636

[22] Filed: Aug. 5, 1998

[30] Foreign Application Priority Data

Aug. 5, 1997 [DE] Germany ..... 197 33 794

[51] Int. Cl.[7] ..... B65B 61/20

[52] U.S. Cl. ..... 53/133.7; 53/141; 53/135.3; 53/212; 53/135.2; 53/170; 156/552

[58] Field of Search ..... 206/242, 245, 206/831; 229/160.1, 87.13; 40/312; 428/43; 53/170, 141, 135.3, 133.7, 135.1, 212, 466; 493/220, 264, 266, 333, 334, 335, 336; 156/552

[56] References Cited

U.S. PATENT DOCUMENTS

| | | | |
|---|---|---|---|
| 2,011,399 | 8/1935 | Driscoll | 206/242 |
| 2,109,100 | 2/1938 | Brophy | 229/87.13 |
| 2,661,139 | 12/1953 | Brooks | 229/160.1 |
| 3,373,045 | 3/1968 | Peterson | 40/312 |
| 3,695,422 | 10/1972 | Tripodi | 206/242 |
| 3,809,227 | 5/1974 | Begemann | 206/264 |
| 4,620,664 | 11/1986 | Kaufman et al. | 206/242 |
| 4,632,721 | 12/1986 | Hoffmann et al. | 156/458 |
| 4,718,216 | 1/1988 | Focke et al. | 53/444 |
| 4,735,668 | 4/1988 | Hoffmann et al. | 156/215 |
| 4,779,733 | 10/1988 | Kilian | 206/459 |
| 5,035,935 | 7/1991 | Thomas et al. | 206/242 |
| 5,250,134 | 10/1993 | Thomas et al. | 206/242 |
| 5,533,613 | 7/1996 | Minarelli et al. | 206/242 |

FOREIGN PATENT DOCUMENTS

| | | |
|---|---|---|
| 262877 | 6/1968 | Austria . |
| 0 773 165 A2 | 5/1997 | European Pat. Off. . |
| 0 803 450 A1 | 10/1997 | European Pat. Off. . |
| 939 977 | 3/1956 | Germany . |
| 42 06 594 | 9/1993 | Germany . |
| 44 37 782 | 5/1996 | Germany . |
| 195 31 839 | 3/1997 | Germany . |
| 195 41 541 | 5/1997 | Germany . |
| 196 16 871 | 10/1997 | Germany . |
| 1 448 014 | 9/1976 | United Kingdom . |
| 95/11832 | 5/1995 | WIPO . |

*Primary Examiner*—Peter Vo
*Assistant Examiner*—Sam Tawfik
*Attorney, Agent, or Firm*—Sughrue, Mion, Zinn, Macpeak & Seas, PLLC

[57] ABSTRACT

Cigarette packs (10) are usually provided with an outer wrapper (13) made of thin, transparent or clear film. Furthermore, cigarette packs (10) are furnished with a (revenue) stamp (25). This is attached to the inner side of the outer wrapper (13) with glue or by other means. A tear-off strip (28) for the outer wrapper (13) is laid in place so that it severs the stamp (25) when torn off. This is connected to the pack by gluing its inner side to the facing side wall (16) of the pack.

3 Claims, 8 Drawing Sheets

Fig. 3
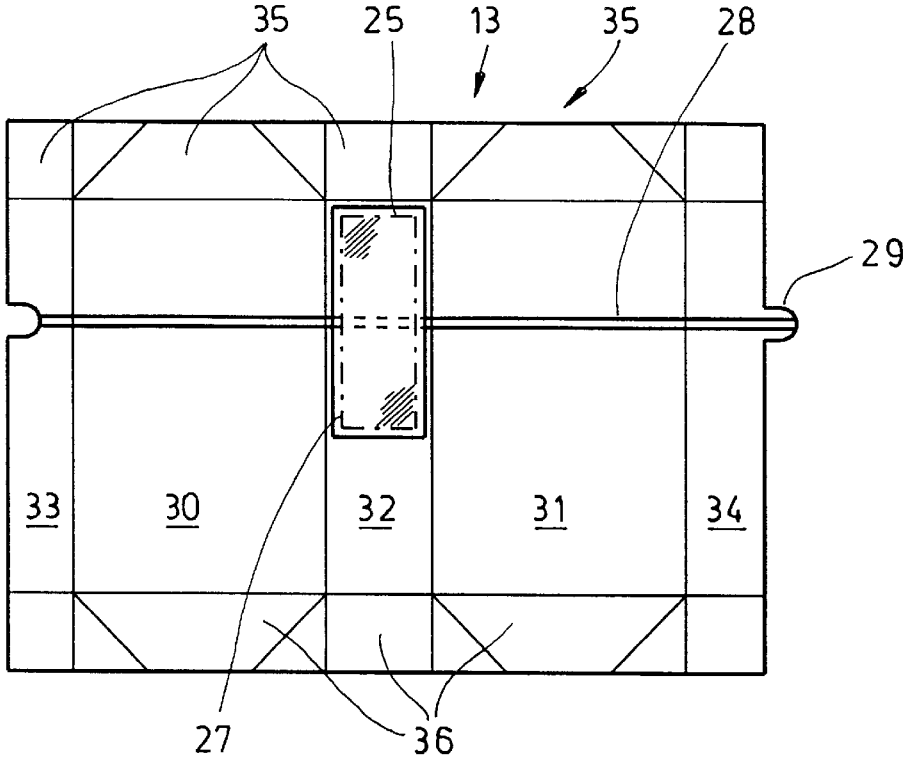
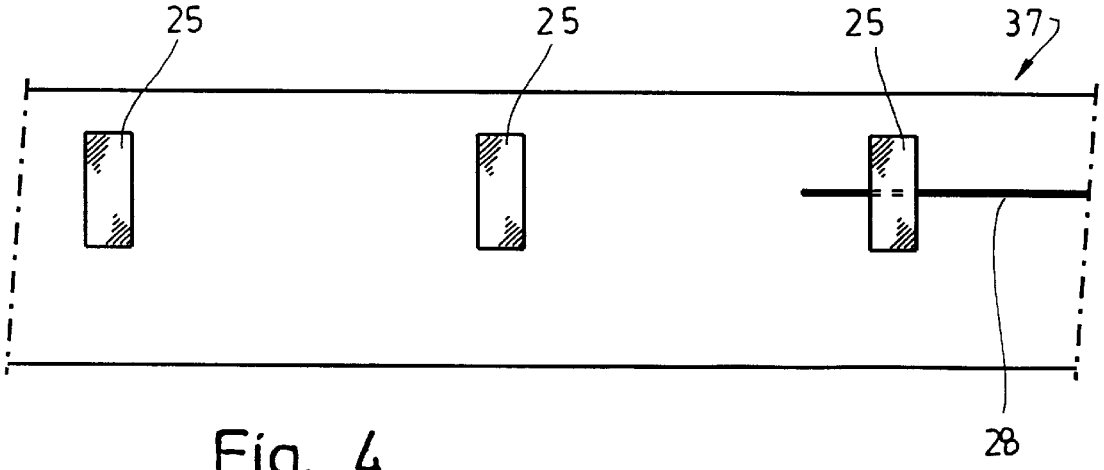
Fig. 4

APPARATUS FOR MANUFACTURING CIGARETTE PACKS

BACKGROUND OF THE INVENTION

The invention relates to a pack for tobacco goods, in particular a pack made of paper, thin cardboard or other appropriate packaging material for receiving a group of cigarettes or a cigarette block and with an outer wrapper made of transparent (plastic) film. Furthermore, the invention relates to the method and apparatus for producing such packs.

Packs for tobacco goods, especially cigarette packs, are for various reasons provided with blanks made of paper or other material which serve as labels in the industrial manufacturing of packs.

SUMMARY OF THE INVENTION

The underlying objective of the invention is to propose a design for a pack, method of manufacture and apparatus hereto for positioning blanks of the previously named type on or in the pack in an appropriate manner and to integrate the positioning process into the industrial manufacture of the packs.

To achieve this objective the pack according to the invention is characterized in that at least one printed blank of paper or the like is arranged between the (cigarette) pack on one hand and the outer wrapper on the other, and that said blank is connected to the inner side of the outer wrapping at least temporarily. A label in the form of a revenue stamp is positioned according to the invention in the region of a tear-off strip or tear-off ribbon of the outer wrapping in such a way that the tear-off strip lying at the inner side of the outer wrapping severs the revenue stamp when the outer wrapper is opened. According to a another feature of the invention, the revenue stamp is in addition permanently attached to the actual cigarette pack, namely to a hinge-lid or a soft-pouch type of pack. Opening the outer wrapper thereby destroys the revenue stamp, thus canceling it. At lease some parts of the severed revenue stamp remain sticking to the pack.

Another special feature relates to the method for producing such packs, namely for applying the outer wrapper. Said outer wrapper is formed from a continuous web of packaging material from which blanks are cut off and held ready for wrapping the packs, either of the hinge lid or soft-pouch type. According to the invention the blank, namely the label or (revenue) stamp is positioned and affixed to the continuous material web at the appropriate position relative to the pack. Accordingly, the blanks severed from the material web exhibit the labels or stamps. When folded around the hinge-lid or soft pouch pack, the label or stamp lies at the desired location on the pack.

The apparatus for executing this method is equipped with members for affixing the blanks for labels, carriers of printed matter, stamps, etc. to the material web. The blanks can be connected to each other with permanent glue, with short-lived glue self-dissolving or (stick-no-stick glue) or with no adhesive at all exclusively by means of electrostatic charging of the material web and/or of the labels.

The particulars of the pack, the manufacturing method and the apparatus will be disclosed in more detail in conjunction with the appropriate drawings as follows:

BRIEF DESCRIPTION OF THE DRAWINGS

FIG. 3 shows a blank for an outer wrapper, FIG. 4 shows a material web for manufacturing blanks according to FIG. 3, FIG. 5 Shows a schematic side view of an apparatus for preparing and manufacturing blanks for outer wrappers.

DESCRIPTION OF PREFERRED EMBODIMENTS

Figure 2:
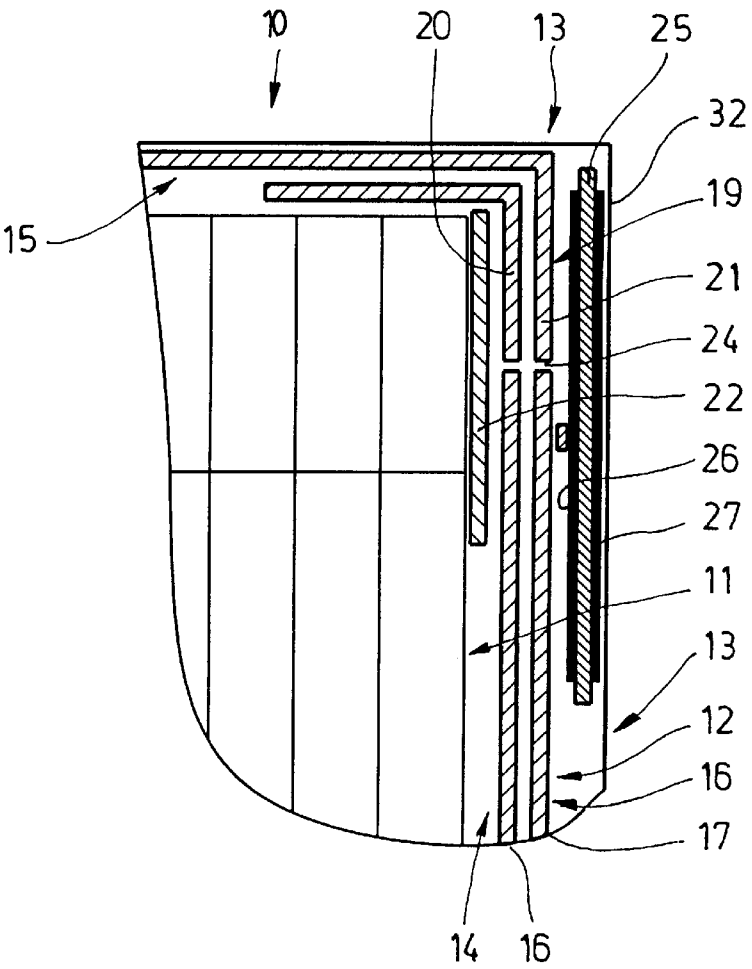
FIG. 2 shows a greatly enlarged vertical cross-section of an upper corner area of the pack according to FIG. 1.

The drawings relate to the preferred area of application, namely the embodiment and manufacture of cigarette packs 10. The latter comprise the actual pack container for receiving the pack contents. Two preferred embodiments of these are shown here, namely on one hand a "hard pack" made of thin cardboard, more specifically a hinge-lid pack 12 in FIG. 1 and FIG. 2, and on the other hand a "soft pack", namely a pouch-type pack or a pouch 65 in FIG. 8.

The contents of a cigarette pack 10 comprise a cigarette group surrounded by an inner blank generally made of tin foil (not shown). This unit forms a cigarette block 11 as the pack contents. The exterior of the cigarette pack 10 is surrounded by an outer wrapper 13, which is formed from a transparent film of plastic or regenerated cellulose.

The hinge-lid pack 12 is of the standard construction, comprising namely a (lower) pack part 14 and an (upper) lid 15. Pack part 14 and lid 15 are connected to each other along a transverse hinge line in the region of a common rear wall.

The blank for the pack part is 14 constructed in such a manner that forms narrow, upright side walls 16 of two layers, namely side tabs 17, 18, which overlap each other completely or in part. The latter are glued to each other. Lid side walls 19 are formed in analogous fashion, namely with two overlapping lid side tabs 20, 21.

Positioned within the pack part 14 is a collar which partially projects out of said pack part 14 and whose collar side tab 22 is shown in FIG. 2. The part of the collar or collar side tab 22 that projects out of the pack part 14 is surrounded by the lid 15 when the hinge-lid pack 12 is closed.

Figure 1:
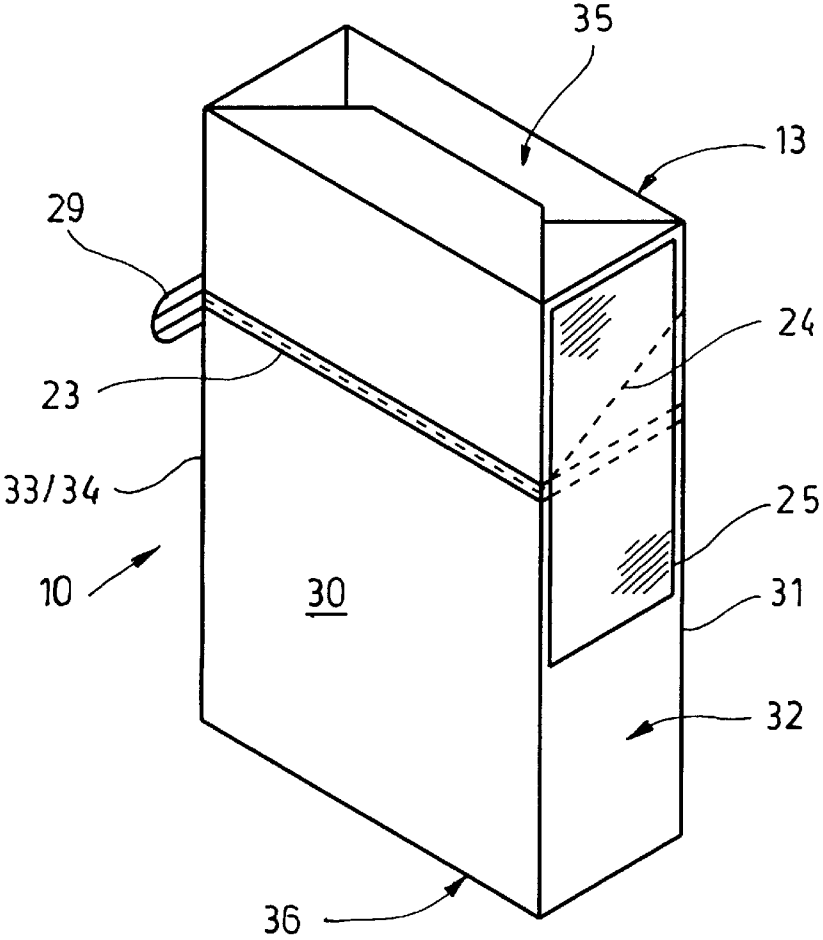
FIG. 1 shows a perspective view of a (cigarette) pack.

The lid 15 forms a transverse abutment or closing edge 23 on the front side of the pack or hinge-lid box 12 facing the pack front wall. Said closing edge 23 also extends into the region of the mutually opposite side walls 16 of the hinge-lid pack 12. A side closing edge 24 is generally directed obliquely, namely with its slope ascending toward rear side of the hinge-lid pack 12 (FIG. 1).

In the present embodiment the pack is provided with a thin rectangular blank made of paper, namely with a (revenue) stamp 25. This blank is positioned in the region of the side wall 16 and lid side wall 19. The side closing edge 24 is covered by the stamp 25.

In the present embodiment the stamp 25 is positioned between the outer side of the side wall 16, 19 on one hand, and the outer wrapper 13 on the other hand. A special feature is that the stamp 25 is connected on one hand to the hinge-lid pack 12 and on the other hand to (the inner side) of the outer wrapping 13. Here a respective layer of glue is provided as the bonding means, that is to say applied to both sides of the stamp 25. Glue is applied as a glue layer 26, 27 covering the entire stamp surface area. In place of a full-surface glue layer 26, 27, other glue patterns, such as glue spots, could also be applied.

The outer wrapping 13 is provided with a tear-off strip 28 running all the way around it. This is attached on the inner side of the outer wrapper 13. A tip 29 is used to grip the tear-off strip 28 at one end and to remove the tear-off strip 28 while severing the outer wrapping 13 at the same time.

The tear-off strip 28 also extends in the region of the stamp 25. As can be seen in FIG. 2, the tear-off strip 28 is positioned between the stamp 25 on one hand and the facing side or wall of the hinge-lid pack 12, in the present case on the side wall of the pack part 14. The tear-off strip 28 is affixed to the side wall 16 by a glue layer 26 and joined to the stamp 25 at the same time. The tear-open strip 18 is pulled off, the stamp 25 is severed (approximately) down the middle. In the present case the tear-open strip 28 runs at the height of the closing edge 23 or below the oblique side closing edge 24.

The manufacture of cigarette packs 10 in this or another embodiment proceeds by affixing the printing carrier or the stamp 25 on the inner side of a blank for the outer wrapping 13 (FIG. 3). The stamp 25 lies against the inner side of the blank of the outer wrapping 13 and the tear-off strip 28 lies against the (inner) side of the stamp 25. As an alternative, the entire length of the tear-off strip 28 can lie directly against the blanks for the outer wrapper 13. In the first version, the tear-off strip 26 is covered by the inner side of the stamp 25. In the alternative version the stamp 25 remains intact on the hinge-lid pack 12 when the outer wrapper 13 is removed with the help of the tear-off strip 28.

The outer wrapper 13 encompasses the hinge-lid pack 12 on all sides. Accordingly, the blank for the outer wrapper 13 forms a front wall 30, a rear wall 31 of the same size, an intermediate side wall 32 and outer side wall tabs 33, 34. The latter together form a side wall of the outer wrapper located opposite the side wall 32 by overlapping and being joined to each other by means of glue or thermal sealing. The border strips of the blank for the outer wrapper 13 form top end folding tabs 35 and bottom end folding tabs 36.

The blanks formed according to FIG. 3 are severed from a continuous material web 37 of thin, transparent film material. Prior to this the stamps 25 are affixed to the material web 37 at a position that exactly corresponds to the position relative to the cigarette package 10, thus here in the region of a side wall 32. Subsequently, likewise during the continuous transport, the continuous, self-adhesive tear-off strip 28 is affixed. The blanks are severed from the material web 37 so prepared at a designated position.

Figure 5:
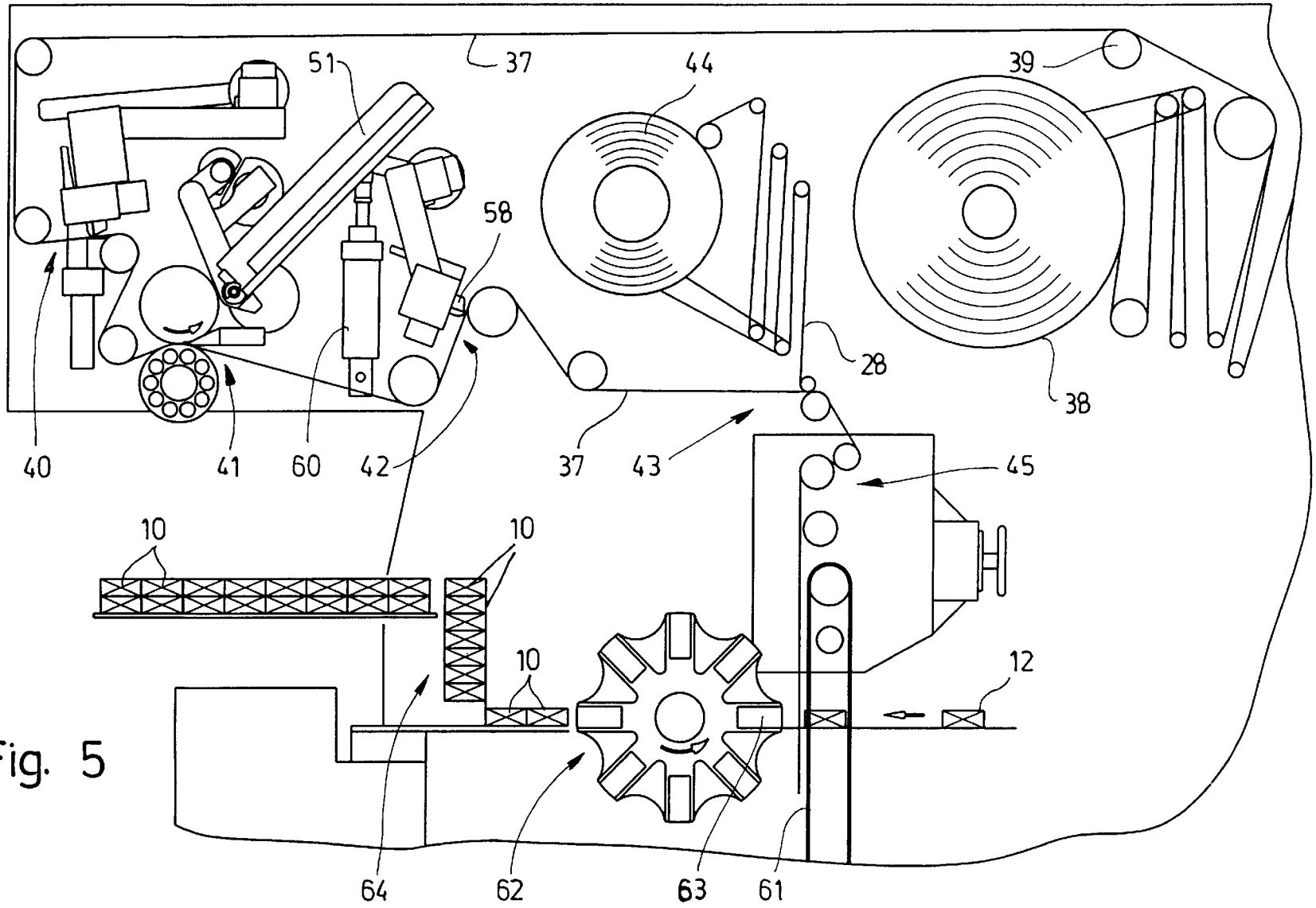
Figure 6:
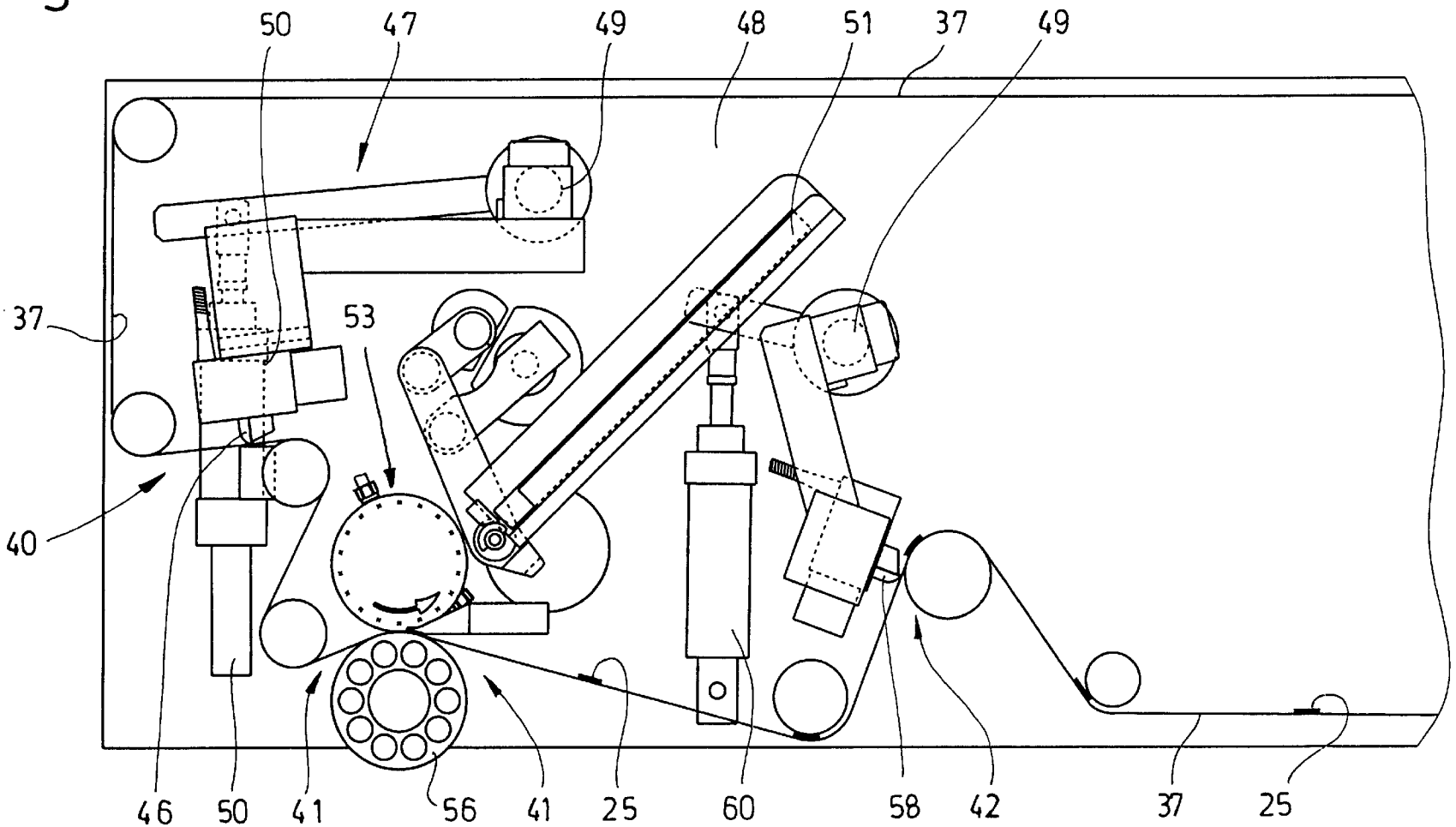
FIG. 6 shows a detail of the apparatus according to FIG. 5 on an enlarged scale.
Figure 7:
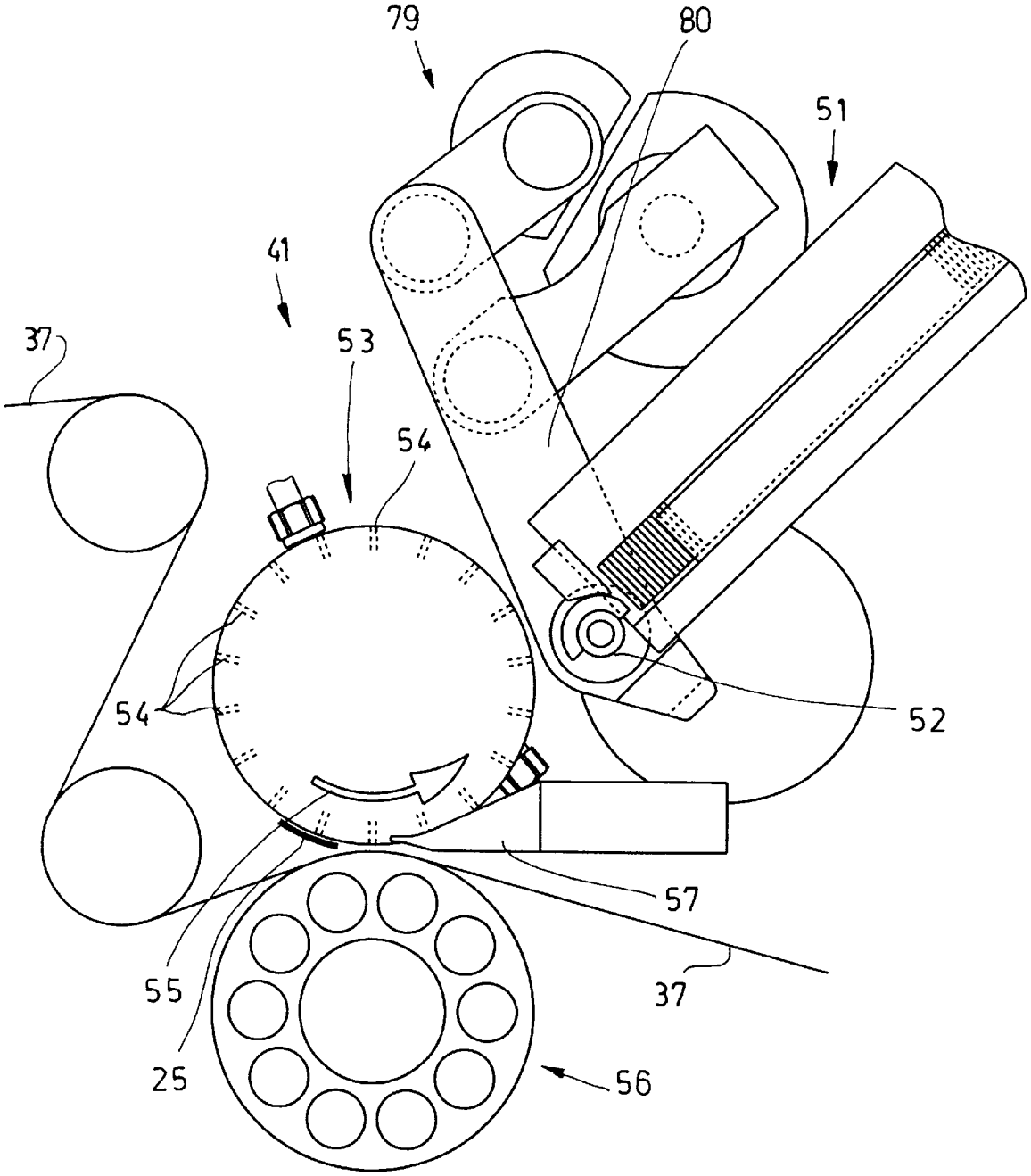
FIG. 7 shows a further enlarged detail of FIG. 5 and FIG. 6.

The details concerning an apparatus for the manufacture or preparation of the material web 37, of the blanks for the outer wrapping 13 and the affixing of the same to the (cigarette) packs 10 are shown in FIG. 5 to FIG. 7.

The material web 37 is preferably continually drawn from a reel 38. The material web 37 is conveyed by way of deflector rollers 39 to the region of a first gluing station 40. Here glue is applied to the material web 37 for affixing the stamp 25, namely the (rectangular or strip-like) glue layer 27. The material web 37 with its exactly positioned glue points or glue layers 27 subsequently arrives in a transfer station 41 where the individual stamps 25 are laid upon the material web 37 in the region of the glue pattern or glue layer 27.

Subsequently the material web 37 is conveyed to another gluing station 42. In this area glue is applied to the exposed side of the stamps 25, namely in particular the glue layer 26.

Afterwards the material web 37 passes through a threading station 43. In this station the continuous tear-off strip 28 is laid upon the material web 37. The tear-open strip 28 is drawn from a strip reel 44.

The material web 37, now provided with the stamps 25 and the tear-off strip 28, then runs through a blank unit 45. Here blanks are severed from the material web 37 according to FIG. 3 and held in place in an upright plane for being received by the packs or hinge-lid boxes 12.

In the first gluing station 40 glue is applied from above in the region of an (approximately) horizontal conveying plane of the material web 37, namely glue layer 27. For this purpose a glue nozzle 46 is activated. Said nozzle 46 is provided with a slit-like nozzle opening. During a precisely controlled opening time and as a result of the material web's conveying movement, a rectangular glue pattern, namely the glue layer 27, is applied.

The glue nozzle 46 is part of a gluing unit 47, which is mounted displaceably on a machine frame, namely on a supporting wall. The gluing 47 can be drawn back from the gluing position (FIG. 6), specifically by swinging horizontally along a drag bearing 49. The actuation of the gluing unit 47 for making a swing movement is provided by a cylinder 50, which is affixed to the supporting wall 48 and whose cylinder rod is connected to the gluing unit 47 or to a swinging arm of the same.

The transfer station 41 features a special design (FIG. 7). The stamps 25 (or other blanks) are taken from a stamp magazine 51. Acting at the open underside of the stamp magazine 51 is a withdrawal member, namely an unwinder 52 operating on a known principle. In each case it takes a single stamp 25 out of the stamp magazine 51 by means of an unwinding movement. The unwinder 52 can be moved back and forth in a lower withdrawal opening of the stamp magazine 51 by means of parallel bars 79. The unwinder itself is mounted on a connecting rod which is part of the parallel bars 79.

The removed stamp 25 is transferred to a transfer member, namely to a transfer roller 53. This is provided with radially directed open suction bores 54 along its circumference for gripping a stamp 25 and for transporting the same by a rotational movement in the direction of the arrow 55. The transfer roller 53 lays the stamps 25 onto the material web 37 in a precise position relative to the pack. In the process the rectangular stamps 25 extend in their longitudinal direction in the axial direction of the transfer roller 53.

For receiving the stamp 25 the material web 37 is led by a doubling roller 56, which is positioned opposite the transfer roller 53. The transfer of the stamp 25 to the material web 37 takes place on the doubling roller 56 in the region where the material web 37 lies upon the doubling roller 56.

To aid the transfer process, a stationary stripper 57 is provided in this region. It is directed approximately tangential to the circumference of the transfer roller 53 and designed such that the front area of the stamp 25 in the traveling direction is led onto the stripper 57 and thereby lifted by the circumference of the transfer roller 53 and pressed onto the material web 37. Furthermore, the suction bores 54 in this region are controlled such that they can be impinged by pressure, thus supporting the release of the stamp 25 from the circumference of the transfer roller 53.

The material web, with the stamp 25 now attached, is then conveyed to the second gluing station 42. In the region of a obliquely rising section glue is applied by a glue nozzle 58 to the exposed side of the stamp 25. The glue nozzle 58 is part of a gluing unit 47 which is designed analogously to glue unit 47 and likewise can be moved, namely in a sweeping movement by a cylinder 60.

The material web 37, now prepared in the described manner, is then in the region of the threading station 43 continuously provided with the tear-off strip 28, which is pressed onto the facing side of the material web 37 and which covers the stamp 25 in the region in which it is located.

The blank unit 45 holds ready in a vertical plane the blanks according to FIG. 3 which have severed from the material web 37. Provided for this purpose are upright suction strips 61, onto which the blanks abut with their lateral areas. The hinge-lid boxes 12, which are conveyed on a horizontal packing line, are sent between the suction strips 61 in the direction of a folding turret 62. In the process the blank held in readiness is taken along by a hinge-lid box 12 and released by the suction strips 61. When a hinge-lid box 12 with outer wrapping 13 is inserted into a pocket 63 of the folding turret 62, the blank of the outer wrapper 13 spreads around the pack or hinge-lid box in a U-shaped manner.

The folding turret 62 is then revolved in steps. In the process the pockets 63 run through folding stations (not shown) in which the folding of the outer wrapper 13 is finished. The finished cigarette packs 10 are shoved out of the folding turret 62 at the side opposite the insertion side and into a packing turret 64. Afterwards the finished cigarette packs 10 are conveyed away for further processing, in particular for the formation of bundles.

When a blank of the outer wrapping 13 being held ready is taken along by a hinge-lid box 12 and when being inserted into a pocket 63 of the folding turret 62, the blank is positioned relative to the hinge-lid box 12 so that a region for forming the side wall 32 of the outer wrapper 13 lies on the side wall 16 and lid side wall 19 facing the blank 13 or located at the front in the direction of movement. In this exemplary embodiment, during this transfer process the stamp 25 with glue (glue layer 26) applied to its blank side is joined to the hinge-lid box 12, namely to the side wall 16/19.

Figure 8:
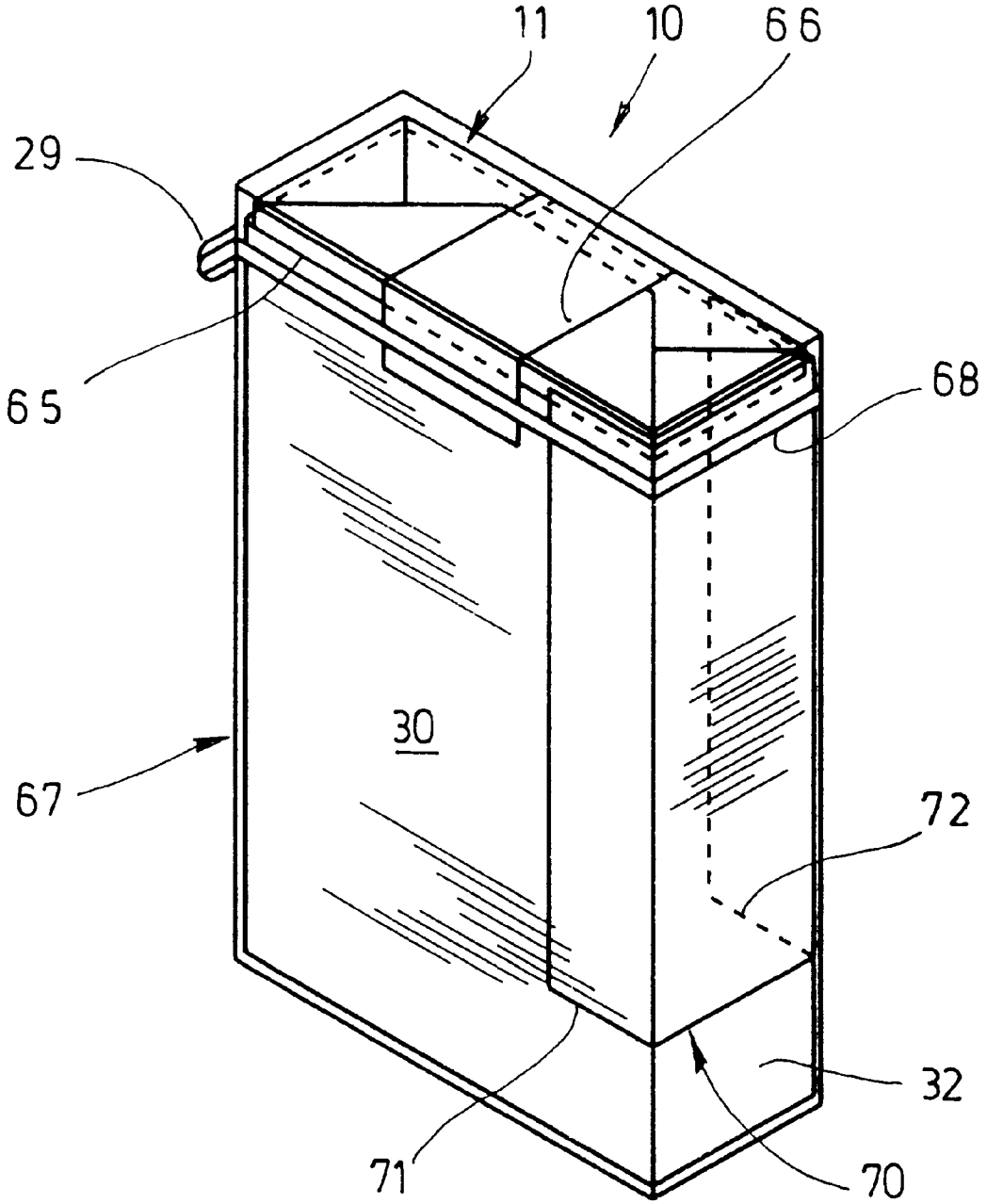
FIG. 8 shows a perspective view of a cigarette pack of the soft-pouch type.
Figure 10:
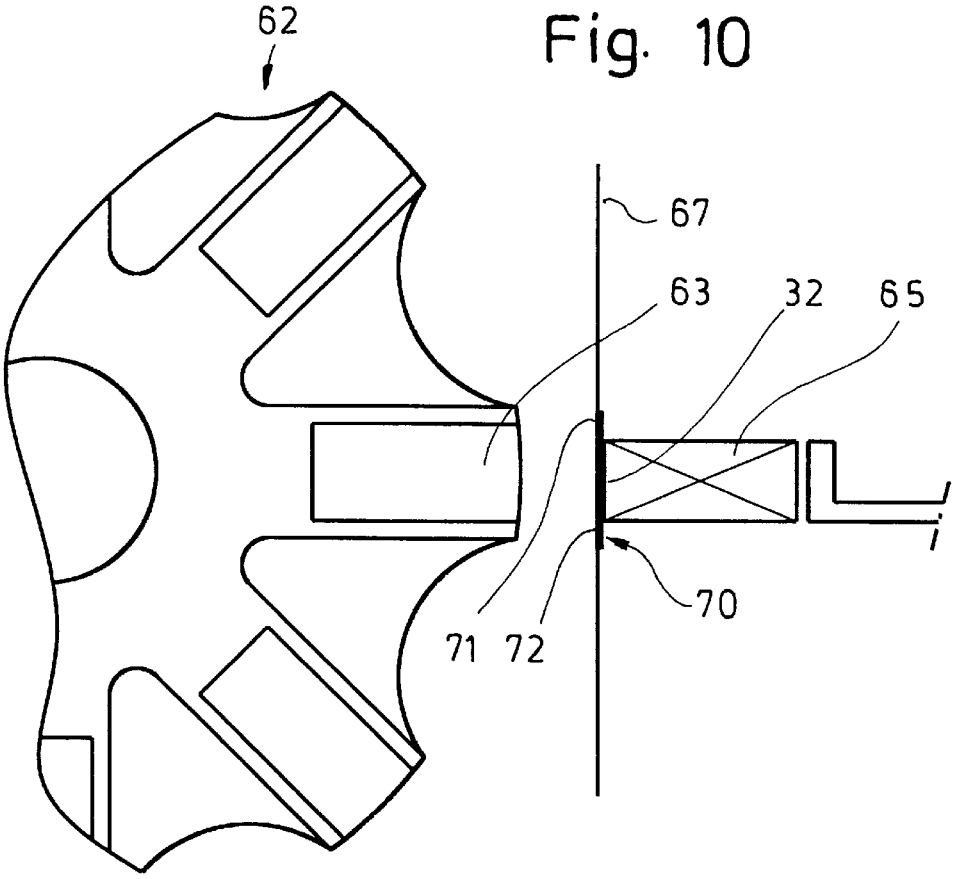
FIG. 10 shows a schematic side view of a detail of an apparatus for manufacturing packs according to FIG. 8.
Figure 9:
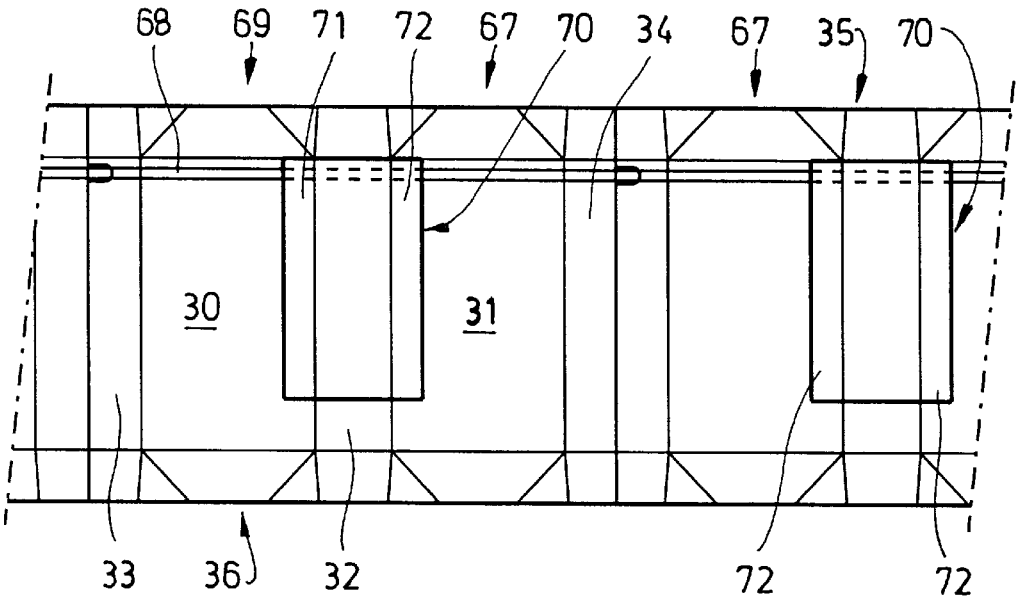
FIG. 9 shows a material web for wrappers for packs according to FIG. 8.

A different exemplary embodiment of a cigarette pack 10 is shown in FIG. 8. This relates to a pack of the soft-pouch type.

The container for the pack contents comprises a pouch 65, open at the top, made of paper or another relatively thin packaging material. The pouch 65 is closed on all sides except for an upper, end face region. Here the pack contents, namely the cigarette block 11, projects slightly out of the pouch 65. A revenue stamp 66 extending transversely across the end face joins the pouch 65 in this region with the pack contents, namely the cigarette block 11.

The pouch 65 and its contents are also surrounded by an outer wrapper 67 which consists of a blank according to FIG. 3. However, a tear-off strip 68 in this example is placed at the upper end face of the outer wrapper 67 (end folding tab 35).

The blanks for the outer wrapper 67 are also severed from a continuous material web 69.

The cigarette pack 10 according to FIG. 8 is provided with a blank 70 which serves as a printing carrier, namely for information, advertising notes, but also for the health warning compulsory in many countries. The rectangular blank 70 is likewise arranged between the transparent outer wrapper 67 and the actual pack, namely the pouch 65, with a printed side facing outwards. Analogous to the described exemplary embodiment, the blank 70 extends in the region of a middle or inner closed side wall 32 of the outer wrapper 67. However, the blank 70 is measured so that a middle region extends across the width of the side wall 32 and legs 71, 72 extend into the region of the adjacent pack surfaces, namely the front wall 30 and rear wall 31. The blanks 70 has a U-shaped cross-section within the cigarette pack 10.

In order to manufacture this kind of cigarette pack 10 the blanks 70 are also placed upon the material web 69 in the appropriate position relative to the pack, namely in the described position in the region of the side wall 32. The material web 69 is prepared in the process so that the tear-off strip 68 is first put in place, followed by the blank 70. As a result, in the finished pack the blank 70 lies on the inner side of the tear-off strip 68. When the pack is opened or when the outer wrapper 67 is severed by pulling off the tear-off strip, the blank 70 remains intact. If it is merely joined to the material web 69 or to the outer wrapper 67, the blank 70 can be removed with the outer wrapper 67. But it is also conceivable that with the appropriate attachment the blank 70 can remain permanently on the pack or soft-pouch 65.

Figure 11:
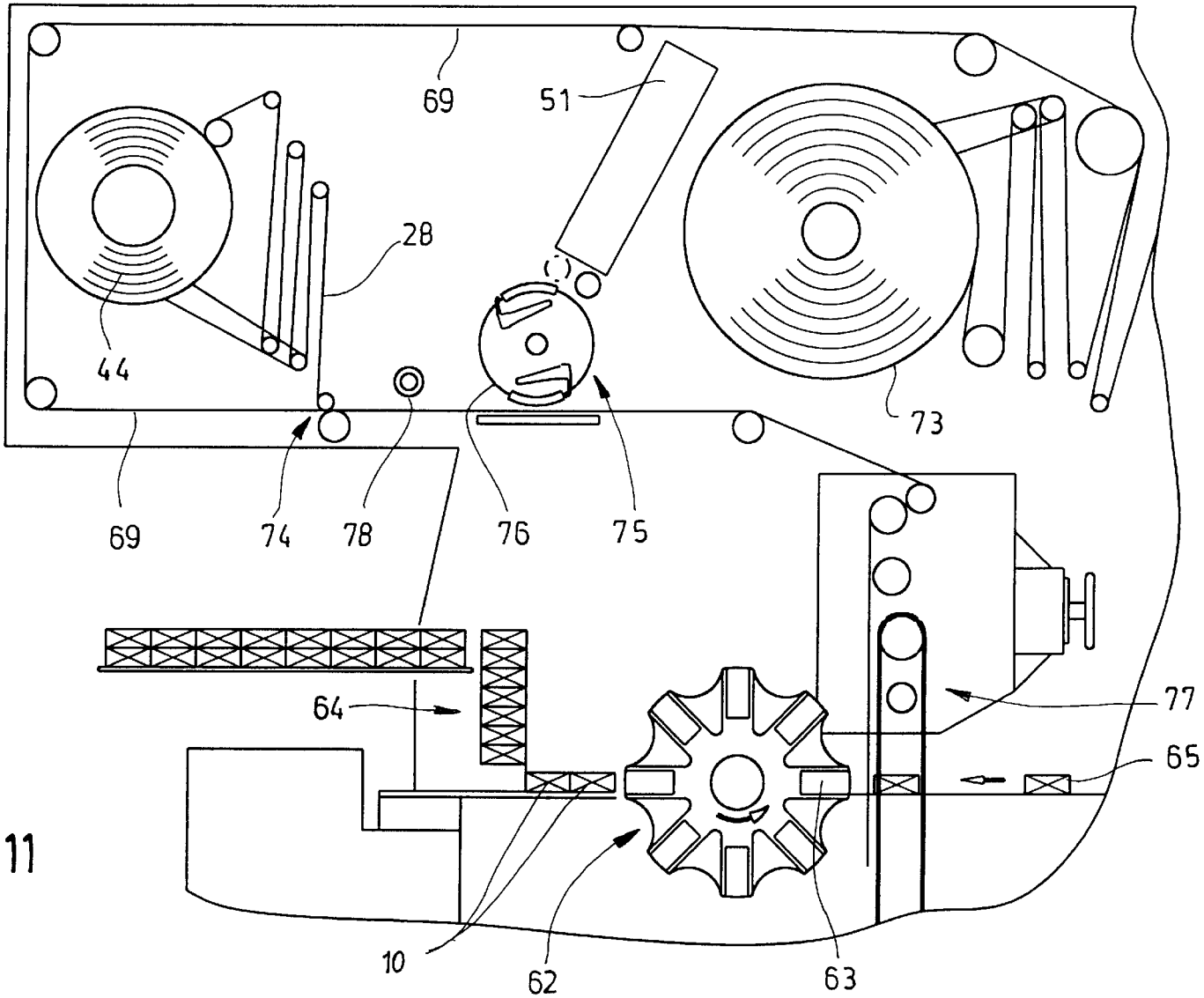
FIG. 11 shows a side view of the entire apparatus for manufacturing packs according to FIG. 8.

The apparatus for manufacturing such packs or for preparing the material web 69 is configured according to FIG. 11 analogous to the apparatus according to FIG. 5. The material web 69 is drawn from a reel 73 and fed to a threading station 74. In its region the tear-off strip 68 is continuously joined to the material web 69.

In the region of a transfer station 75 the individual blanks 70 are positioned precisely by guide rollers 76 on the material web 69, namely in the region of the side wall 32. In the process, glue is applied to the side of the blanks 70 facing the material web 69.

Once prepared in this fashion, the material web 69 is fed to a blank unit 77. Here blanks are produced for the outer wrapper 67 and held ready for being taken along by soft-pouch packs 65.

When the soft-pouch pack with a blank for the outer wrapper 67 is inserted into a pocket 63 of the folding turret 62, not only is the outer wrapper 67 folded in a U-shape but the blank 70 attached to it is also folded. Accordingly, the legs 71, 72 are also folded during this insertion movement.

The stamps 25 or blanks 70 can also be attached to another position within the outer wrapper 13 or 67, for example, in the region of front wall 30 and/or rear wall 31.

In addition, special features relating to the type of attachment are also possible. The kind of attachment of the stamps 25 or blanks 70 to the material web 37 or 69 can be chosen such that the attachment is effective only for the duration of the folding process in the region of the blank unit 45, 77 or of the folding turret 62. This can be achieved, for example, by using a glue, in other words a glue layer 27, that automatically loses its adhesive strength after a certain time a self-dissolving or (so-called stick-no-stick glue). One special alternative is to attach the stamp 25 or blank 70 to the material web 37, 69 without using glue, namely by electrostatic charging of the material web 37, 69. In the apparatus according to FIG. 11 a schematically represented activation member 78 is shown which activates an electrostatic charge in the material web 69 as it passes by. The next blank 70 that is laid down remains attached to the material web 69 by means of the electrostatic charge for a sufficient amount of time and with a sufficient amount of adhesive strength.

The relative position of the tear-open strip 28, 68 should be selected so that-depending upon the intended purpose-the stamp 25 or blank 70 is destroyed by the tear-open strip 28, 68 when the cigarette pack is opened.

The material web 37 or 69 can be prepared in the region of the packaging machine in the described manner. However, it is also possible to prepare the material web in part outside of the packaging machine, namely in the production area of the film web. In this case, the carrier of printed matter—stamp 25 or blank 70—are already attached during the manufacture of the film or material web, namely by being glued to the material web. The latter is then wound on a reel and sent to the packaging machine in this prepared version. In the region of the packaging machine only the tear-off strip 28 has to be attached as usual.

What is claimed is:

1. An apparatus for manufacturing cigarette packs (10) each being provided with a container, made of paper or thin cardboard, for receiving a cigarette block (11), with an outer wrapper (13, 67) made of transparent film, and with a carrier of printed matter disposed between the container and the outer wrapper (13, 67), said apparatus comprising:

a) means for feeding a continuous web of material (37, 69) for the outer wrapper (13, 67) downstream to a first gluing station (40) for application of glue patterns onto the web (37, 69);

b) means, following the first gluing station (40), for feeding the web (37, 69), now provided with glue patterns, to a transfer station (41) where the carriers of printed matter are attached to the web (37, 69) in regions of the glue patterns; and c) following the transfer station (41), a second gluing station (42) for applying glue to an exposed side of each carrier of printed matter that is attached to the web (37, 69).

2. The apparatus according to claim 1, further comprising, upstream of the transfer station (75) for the carriers of printed matters, an activating member (78) which electrostatically charges the web (69) before each carrier of printed matter is attached.

3. The apparatus according to claim 1, wherein the second gluing station (42) is followed by a threading station (43) where the web (37, 69) is continuously provided with a tear-off strip (28, 68) in a region of each carrier of printed matter.

* * * * *